US006834470B2

(12) United States Patent
Tadich

(10) Patent No.: US 6,834,470 B2
(45) Date of Patent: Dec. 28, 2004

(54) STRUCTURAL FRAMEWORK, METHOD OF FORMING THE FRAMEWORK AND WEBS THEREFOR

(75) Inventor: John Tadich, Knoxfield (AU)

(73) Assignee: MiTek Holdings, Inc., Wilmington, DE (US)

( * ) Notice: Subject to any disclaimer, the term of this patent is extended or adjusted under 35 U.S.C. 154(b) by 78 days.

(21) Appl. No.: 10/205,484

(22) Filed: Jul. 25, 2002

(65) Prior Publication Data

US 2003/0019183 A1 Jan. 30, 2003

(30) Foreign Application Priority Data

Jul. 27, 2001 (AU) ..... PR6667

(51) Int. Cl.[7] ..... E04C 3/02

(52) U.S. Cl. ..... 52/690; 52/693; 52/696; 52/DIG. 6

(58) Field of Search ..... 52/690, 693, 696, 52/DIG. 6

(56) References Cited

U.S. PATENT DOCUMENTS

| | | | |
|---|---|---|---|
| 1,865,059 | A | 6/1932 | Ragsdale |
| 2,803,045 | A | 8/1957 | Horner |
| 3,305,988 | A | 2/1967 | Halopoff |
| 4,295,318 | A | 10/1981 | Perlman |
| 4,637,195 | A | 1/1987 | Davis |
| 4,682,460 | A | 7/1987 | Reetz |
| 4,875,666 | A | 10/1989 | Hain |
| 5,003,748 | A | 4/1991 | Carr |
| 5,608,970 | A | 3/1997 | Owen |
| 5,810,341 | A | 9/1998 | Williams |
| 5,854,747 | A | 12/1998 | Fairlie |
| 5,884,448 | A | 3/1999 | Pellock |
| 5,893,253 | A | 4/1999 | Lutz |
| 5,937,608 | A | 8/1999 | Kucirka |
| 5,941,514 | A | 8/1999 | Burcaw |

FOREIGN PATENT DOCUMENTS

| | | |
|---|---|---|
| AU | 295018 | 10/1967 |
| GB | 263396 | 12/1926 |
| GB | 1232592 | 5/1971 |
| GB | 1 286 122 | 8/1972 |
| GB | 2158122 A | 11/1985 |
| NZ | 210049 | 9/1988 |
| NZ | 314829 | 5/1998 |
| NZ | 305606 | 7/1999 |
| WO | WO 98/59128 | 12/1998 |
| WO | WO 00/37745 | 6/2000 |
| WO | WO 00/59695 A1 | 10/2000 |
| WO | WO 01/14658 A1 | 3/2001 |

*Primary Examiner*—Brian E. Glessner
(74) *Attorney, Agent, or Firm*—Senniger Powers

(57) ABSTRACT

A structural framework, method for forming the framework and web member for the framework are disclosed. The web member has a body and tabs at each end of the body bent at a predetermined oblique angle with respect to an axis of the body. The tabs can include an ancillary connector to temporarily locate and hold the web member in position until the web member is secured in place. The method for forming the framework comprises defining a theoretical connection point on at least one chord of the framework which provides structural integrity, and connecting a web member to the chords at a web member connection point spaced from the theoretical connection point.

7 Claims, 11 Drawing Sheets

STRUCTURAL FRAMEWORK, METHOD OF FORMING THE FRAMEWORK AND WEBS THEREFOR

FIELD OF THE INVENTION

This invention relates to a structural framework, a method of forming a framework and webs therefor and, in particular, but not exclusively, to a structural framework in the form of a building truss including at least one top chord arranged obliquely to a generally horizontal bottom chord. The invention also relates to a pedestal for use in the manufacture of such frameworks.

BACKGROUND OF THE INVENTION

Our International Patent Application No. PCT/US00/23367 discloses a structural framework in the form of a building truss which includes metal web members which extend between the top chords of the truss and the bottom chord of the truss. The reinforcing web members in one form as disclosed in the above International application comprise tubular members of circular cross section which have deformed ends to provide flattened tabs which extend parallel to the longitudinal axis of the web member. The tabs are bent during installation so as to lie flush with a surface of the chords to which the reinforcing members are to be connected. In conventional wooden trusses, adjacent reinforcing web members are arranged so that the web members contact one another. Indeed, in the formation of conventional trusses which have wooden reinforcing web members, the web members contact one another so that compressive and tensile loads applied to the truss are transferred from the chords and absorbed by the truss. In general practice the wooden web member which is to undergo compression contacts the adjacent web member which undergoes tension and the two web members are connected to a chord of the truss by a common connector plate.

In the formation of conventional structural frameworks, in particular, wooden trusses which have oblique top chords and a generally horizontal bottom chord, the chords are laid out on pedestals which are positioned to define the general configuration of the truss. The chords can be held in place by clamps which abut outer surfaces of the chords. Reinforcing web members cut from wood are connected to the chords at predetermined locations and the prescribed length of the wooden reinforcing web members and their proper installation in the truss define the final configuration of the truss. In particular, the wooden members are generally cut to have an end face at each end and the end face of a web member is positioned at a predetermined location and secured to a chord. The other end face is then pulled into engagement with an opposed chord until the end face sits flush with the opposed chord thereby indicating that the web member is in position. This may require some movement of the chord so that the chord does sit flush with the end of the web member. Such movement may be necessary to take a bow out of the chord. When the end is positioned flush with the chord, the end is secured in position. Thus, the final exact shape of the framework and, in particular, the chords of the framework is provided by the installation of the reinforcing web members in the framework.

In the formation of structural frameworks in which metal web members are used, the manner of connecting the metal web members, as described in the above International application, does not allow the installation of the web members themselves to define the configuration of the truss.

Furtherstill, in conventional frameworks which have wooden web members, the web members are laid out and secured in order because of the need to abut adjacent web members together. This therefore requires a workman to work in a particular sequence and the workman does not have the luxury of installing any particular web member at any particular time.

SUMMARY OF THE INVENTION

The object of the invention is to provide improvements to the structural frameworks and their method of manufacture disclosed in the above International application and also to the conventional wooden trusses.

The invention in a first aspect provides a method of forming a structural member having at least one top chord and at least one bottom chord, including the steps of:

defining a theoretical connection point on at least one of the chords which provides structural integrity of the framework;

connecting the metal web member to the bottom chord and to the top chord so that the web member is connected to the said one of the bottom chord or the top chord at a web member connection point spaced from the theoretical connection point.

The formation of the structural framework with web members connecting the bottom chord and spaced from the theoretical connection point by a predetermined distance, enables greater flexibility in the selection of metal web members because adjacent web members do not have to be, and in fact are not, in actual physical contact with one another. Thus, web members from a stock set of web member lengths are more easily selected for use in the truss and more easily assembled in the truss because of the ability to space the connection points of the web members from a theoretical connection point by a predetermined distance.

Preferably the method includes connecting a plurality of web members between the top chord and bottom chord so that the web members are inclined with respect to the chords and define pairs of web members which have a first end which are closer to one another than a second end of the web members of each pair, and wherein the said first ends are both connected to one of the chords at web member connection points which are spaced apart from the theoretical connection point with the theoretical connection point being between the web member connection points of the first ends of the web members.

Preferably the step of connecting the web members at the web member connection points comprises spacing the web member connection points apart from the theoretical connection point by a predetermined distance.

Preferably the step of spacing the web member connection points apart by the predetermined distance comprise connecting the chords to the bottom truss within a predetermined distance range from the theoretical connection point but not outside the predetermined distance range.

Preferably the method includes the step of providing support means on which the chords are supported and the pedestals having markings which define the predetermined distance range in which the reinforcing web members can be connected to the web member.

Preferably the method includes the step of providing the reinforcing web member with tabs which are bent with respect to the longitudinal axis of the web member at an oblique angle with respect to the longitudinal axis of the web member, locating a tab against a surface of one of the chords and securing the tab to the chord, manually pulling the web member so as to bring the tab at the other end of the web member into engagement with another of the chords and to cause the said tabs to further bend so as to sit flush with the chords, and securing the other of the tabs in position.

Preferably the step of securing the web members includes providing temporary connection means on at least the said other tab so that when the said other tab is pulled into engagement with the other chord, the ancillary connection means temporarily connects and holds the reinforcing web member in position to facilitate final securement of the other said tab to the other said chord. Preferably the step of providing ancillary connection means comprises providing a barb on the web member which engages and penetrates the chord to temporarily locate and hold the web member in position.

Preferably the barb is formed by bursting a hole through the tab, or forming a tooth on the tab adjacent an edge portion of the tab.

Preferably the support means comprises at least one pedestal. However, in other embodiments the support means could comprise a support table or platform with moveable support elements.

The invention may also be said to reside in a method of forming a structural framework having at least one top chord and at least one bottom chord, including the steps of:

providing support means for supporting the chords of a framework, with the support means including markings which define connection regions at which ends of reinforcing web members can be connected to the chords of the framework;

laying the at least one top chord and the bottom chord on the support means; and connecting the reinforcing web members between the at least one top chord of the framework and the bottom chord of the framework by securing the ends of the reinforcing web members within the connection regions marked on the support means.

Preferably the step of providing support means comprises the step of moving the support means to predetermined positions so as to define the connection regions of the reinforcing web members to the chords when the chords are laid on the support means.

Preferably the step of providing the markings includes providing a marking which defines a theoretical connection point, and a marking which defines, with a theoretical connection point, the connection region.

Preferably the step of providing the markings further includes providing a marking which defines a preferred connection point between the theoretical connection point and the marking which defines the connection region with the theoretical connection point.

Preferably the support means comprises at least one pedestal. However, in other embodiments the support means could comprise a support table or platform with moveable support elements.

Preferably the method includes the step of providing the reinforcing web member with tabs which are bent with respect to the longitudinal axis of the web member at an oblique angle with respect to the longitudinal axis of the web member, locating a tab against a surface of one of the chords and securing the tab to the chord, manually pulling the web member so as to bring the tab at the other end of the web member into engagement with another of the chords and to cause the said tabs to further bend so as to sit flush with the chords, and securing the other of the tabs in position.

Preferably the step of securing the web members includes providing temporary connection means on at least the said other tab so that when the said other tab is pulled into engagement with the other chord, the ancillary connection means temporarily connects and holds the reinforcing web member in position to facilitate final securement of the other said tab to the other said chord.

Preferably the step of providing ancillary connection means comprises providing a barb on the web member which engages and penetrates the chord to temporarily locate the web member in position.

Preferably the barb is formed by bursting a hole through the tab, or forming a tooth on the tab adjacent an edge portion of the tab.

The invention may also be said to reside in a support member for supporting a chord of a structural framework, the support member including:

an upper support region for supporting the chord; and markings on the upper support portion for defining at least one connection region in which a reinforcing web member of the structural framework can be connected to a chord of the framework when the chord is supported on the support member.

Preferably the markings include a first marking which shows a theoretical connection point and a second marking which shows a desired connection point.

Preferably the markings further include a third marking which defines, with the first marking, the connection region.

Preferably the support member comprises a pedestal for coupling with a rail member on which the pedestal can move from one place to another.

The invention, in a further aspect, may be said to reside in a structural framework including:

at least one top chord;

at least one bottom chord;

at least two adjacent metal web members extending between the top chord and the bottom chord, the adjacent web members each having a respective end connected to one of the chords so that the respective ends are spaced apart from one another, and with the end of one of the web members being connected to the chord a first distance spaced from a theoretical connection point and the end of the other web member being connected to the chord a second distance spaced from the theoretical connection point, the theoretical connection point being between the two ends of the respective web members which are connected to the chord, and so that the adjacent web members do not abut one another.

This aspect of the invention provides considerably greater freedom in connecting the web members to the chords because the web members do not need to abut one another, but rather are spaced on either side of a theoretical connection point which is used in analysis of the framework design to determine where web members should be located in order to provide the required structural integrity of the framework. Since the web members do not abut one another, the web members can therefore be laid out in any particular order and can be connected in any sequence. This provides a workman or workmen with greater freedom in connecting ends of the chords and therefore provides for the possibility of greater productivity in that frameworks can be assembled much quicker than in the past.

Preferably the first distance is the same as the second distance.

Preferably the ends of the web members are connected to the chord at predetermined web member connection points spaced from the theoretical point.

Preferably the web members are connection to the chords within a connection range which includes the preferred web member connection point for each of the respective web members.

Preferably the web members include tabs which sit flush with a surface of the chord and the tabs are connected to the chord by screws which pass through a hole in the tab.

Preferably the hole defines the connection point of the respective web members to the chord.

A further aspect of the present invention is directed to defining the final configuration of the chords of a framework which is to have metal reinforcing web members.

A further aspect of the invention may therefore be said to reside in a method of forming a structural framework having at least one top chord and at least one bottom chord, including the steps of:

laying the top chord and the bottom chord on one or more support members;

clamping inner surfaces of the chords against an abutment located adjacent an outer surfaces of the chords so as to define the final configuration of the top chord and the bottom chord of the framework; and securing metal reinforcing members between the top chord and the bottom chord.

During the installation step of the reinforcing web members, ends of the reinforcing web members are secured to surfaces of the chords by driving a screw through the reinforcing web members and into the surfaces of the chords. This step tends to pull the chords inwardly and inward movement of the chords which, if the chords were not clamped from the inner surfaces, could cause a deformation of the chords. Since the inner surfaces of the chords are clamped, the chords are prevented from deforming and therefore do not change their required geometrical configuration during installation of the reinforcing web members.

In the preferred embodiment, the reinforcing web members are secured so that the web members connect with the chords at a prescribed distance from a theoretical connection point. This aspect of the invention has particular application to this preferred embodiment because if the chords are connected at positions away from the theoretical connection point, it is completely impossible, unless the inner surfaces of the chords are clamped and prevented from moving, to ensure that installation of the web members will define the correct geometrical shape of the structural framework. Thus, by clamping the inner surfaces so that the geometrical shape of the framework is determined and fixed before the web members are installed, the geometrical shape does not change during installation of the web members regardless of how or where the web members are connected to the chords.

A further aspect of the invention may be said to reside in a method of forming a structural member having at least one top chord and at least one bottom chord, the method including the steps of:

providing a metal reinforcing web member having connection tabs at each end with at least one of the connection tabs having an ancillary connection means;

securing one of the tabs to one of the chords;

moving the reinforcing web member so that the other of the tabs, which includes the or one of the ancillary connection means, is brought into engagement with the other of the chords and so that the ancillary connection means connects to the chord and temporarily holds the reinforcing member in position; and connecting the other of the tabs to the other of the chords to permanently secure the other tab to the other chord.

This aspect of the invention enables the reinforcing web members to be pulled into engagement with the chords and for the ancillary connection means to hold the chord in position so the web member can be fully released by a workman and the workman then has two free hands to permanently secure the other of the tabs in position. Thus, it is not necessary for the workman to hold the reinforcing web member in position and use one hand to secure the tab or for two workmen to perform this operation. Furtherstill, since the tab is connected to the chord and held in place by the ancillary connection means, the reinforcing web member and tab can be properly located in position and will hold that position until the tab is permanently connected to the chord. This prevents the reinforcing web member from moving slightly if it is released which would change its position from that at which the workman intends to secure the tab. Thus, the tab can therefore be more easily located in position and flush with a surface of the chord and the reinforcing web member tightly and accurately secured in position.

Preferably the step of temporarily locating the other tab in position by the ancillary connection means comprises the step of locating the tab in position so that the ancillary connection means penetrates the chord to hold the chord in place.

Preferably the step of providing the other tab with the ancillary connection means comprises providing the tab with at least one barb which can penetrate a chord to hold the tab in position.

Preferably the step of providing the barb comprises providing the barb by forming a burst hole through the tab, or forming a tooth on a side edge of the tab.

This aspect of the invention may also be said to reside in a metal reinforcing web member for a structural framework, said web member including:

a web member body;

at least one securement tab at one end of the web member body; and ancillary connection means on the reinforcing web member for holding the tab in position when the reinforcing web member is located in position in the framework to enable a workman to permanently secure the tab to the chord.

Preferably the reinforcing web member has tabs at each end and each tab is provided with a said ancillary connection means.

In one embodiment the ancillary connection means may be provided by at least one barb on the tab.

The barb may be provided by a burst hole with the barb comprising metal which is deformed from the tab during formation of the burst hole.

In another embodiment the barb may be provided in the form of a tooth arranged at a side edge of the tab.

A further aspect of the invention may be said to reside in a metal reinforcing web member for use in a structural framework, said web member including:

a web member body;

at least one flattened tab formed at one end of the web member body;

the web member body being formed from a tube of metal having free edges which are adjacent one another and which define therebetween a longitudinal slot; and a deformation forming a transition from the web member body to the tab, the deformation including a valley and the valley being aligned with the longitudinal slot in the web member body.

Preferably the valley includes a slit formed by forcing the free edges in the vicinity of the deformation away from one another during formation of the valley, the slit being a continuation of the said slot.

Preferably the slit includes a wide central portion which tapers towards a first end adjacent the slot and towards a second end adjacent the tab.

A further aspect of the present invention may also be said to reside in a reinforcing web member for a structural framework, the reinforcing web member including:

a web member body;

at least one connection tab at one end of the web member body; and the connection tab being bent at an oblique angle with respect to the longitudinal axis of the web member body before installation of the web member into the framework.

Preferably both ends of the web member body include connection tabs and one of the said tabs is bent to the predetermined oblique angle in one direction and the other of the tabs is bent to the predetermined oblique angle in an opposite direction.

Preferably the predetermined oblique angle is an angle of about 30° with respect to the longitudinal axis of the web member body.

Preferably the web member body is circular in transverse cross section.

Preferably the tab is formed by deforming the end of the web member so as to form a flattened tab and a transition region extending from the tab to the web member body, the transition region including a pressed valley extending between two ridges.

Preferably the transition section includes a pair of opposed valleys defined between a respective pair of ridges.

Preferably the tabs include a punched hole for receiving a fastener to secure the tabs to chords of the structural framework.

Preferably the tab includes ancillary connection means for temporarily holding the tab and therefore the reinforcing web member in position during installation of the reinforcing web member in the structural framework.

Preferably the ancillary connection means includes at least one barb formed on the tab.

Preferably the at least one barb is formed by forming a burst hole with the barb being material deformed during the formation of the burst hole.

In another embodiment the barb comprises a tooth formed on an edge portion of the tab.

Preferably, according to each of the aspects of the invention described above, the framework comprises a framework having a bottom chord and at least one top chord which is arranged obliquely with respect to the bottom chord.

BRIEF DESCRIPTION OF THE DRAWINGS

Preferred embodiments of the invention will be described, by way of example, with reference to the accompanying drawings in which.

DESCRIPTION OF THE PREFERRED EMBODIMENTS

Figure 1:
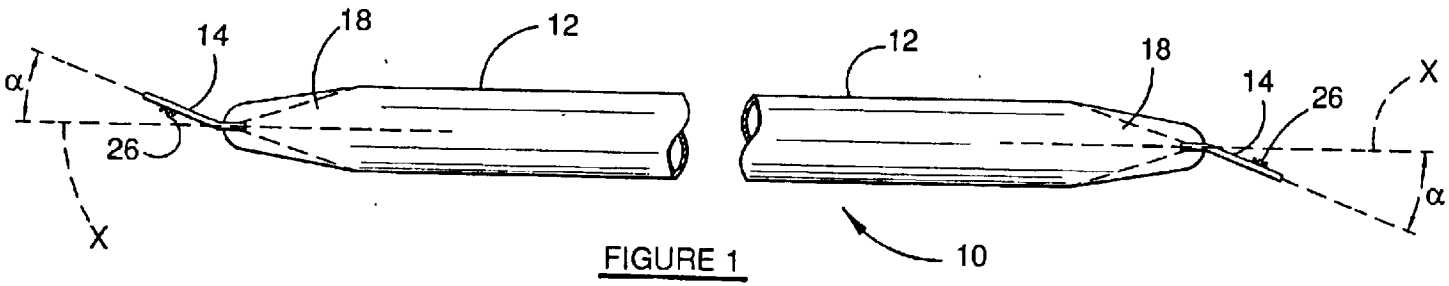
FIG. 1 shows a side view of a reinforcing web member according to one embodiment of the invention.

FIG. 1 shows a reinforcing web member 10 according to the first embodiment of the invention. The web member 10 has a web member body 12 and tabs 14 at each end. The tabs 14 are connected to the body 12 by a transition section 18, which is a deformation created in order to flatten ends of the tubular member from which the reinforcing web member 10 is formed, to provide the tabs 14. Our co-pending International application PCT/US00/23367 discloses in more detail the manner in which the tabs 14 and deformation 18 is formed and the contents of this International application are incorporated into this specification by this reference.

In this embodiment the body 12 is formed from a complete tube of generally circular transverse cross section.

The tabs 14 are bent at a predetermined oblique angle with respect to the longitudinal axis X of the web member 10 of, for example, 25° to 50° and most preferably about 30° as shown by arrow a in FIG. 1. As is clearly seen in FIG. 1, one of the tabs 14 is bent in one direction with respect to the axis X and the other tab 14 is bent in the opposite direction with respect to the axis X so that each are inclined towards a position the tabs will take up when the web member 10 is installed in a building truss as will be described in more detail hereinafter. The pre-bending of the tabs 14 produces an initial bend in the direction the tabs will move upon installation of the web member to take up their final orientation with respect to the web member body 12. This tends to ensure that the radius of curvature between the tabs 14 and the transition section 18 after the tabs 14 are bent to their final orientation, will be as small as possible so that the tabs 14 sit flush and tightly against surfaces of the respective chords between which the web member 10 is located.

Figure 2:
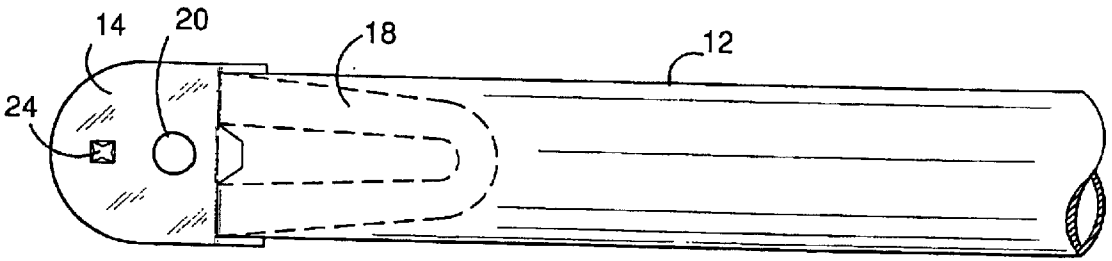
FIG. 2 is a plan view of one end of the web member of FIG. 1.

As best shown in FIG. 2, the tabs 14 include a hole 20 which will receive a screw for permanently securing the tabs 14 to the chords of the truss.

Figure 2A:
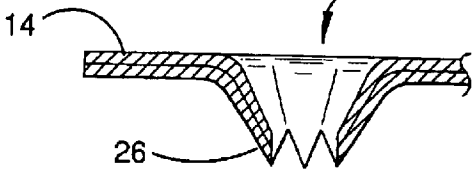
FIG. 2A is an enlarged view of part of the web member of FIGS. 1 and 2.

The tabs 14 are also formed with a burst hole 24 shown in detail in FIG. 2A which is punched through the tabs 14 so as to deform metal from the tabs which produces barbs 26 which project transversely with respect to the tabs 14. The barbs 26 form ancillary connections for temporarily holding the web member 10 in place during installation of the web member 10 in the truss as will also be described in more detail hereinafter.

Figure 3:
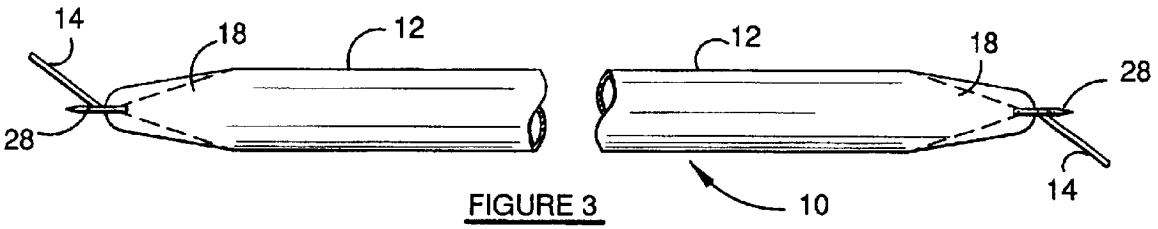
FIG. 3 is a side view of a reinforcing web member according to a second embodiment of the invention.
Figure 4:
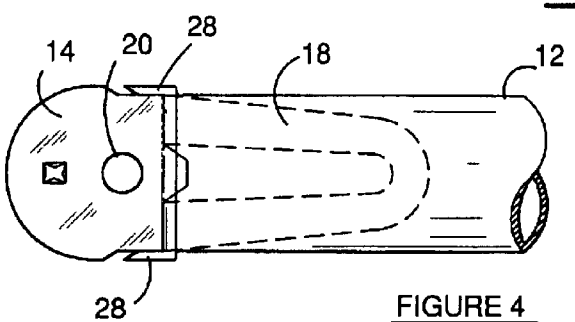
FIG. 4 is a plan view of one end of the web member of FIG. 3.
Figure 4A:
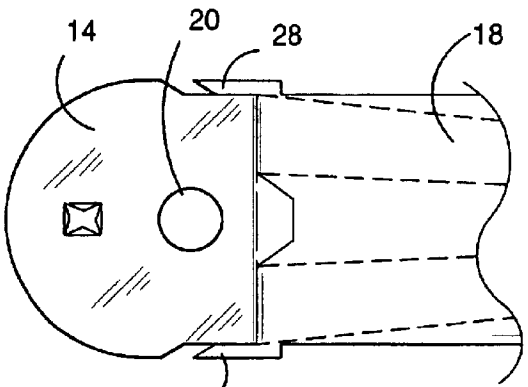
FIG. 4A is an enlarged view of part of the web member of FIGS. 3 and 4.
Figure 4B:
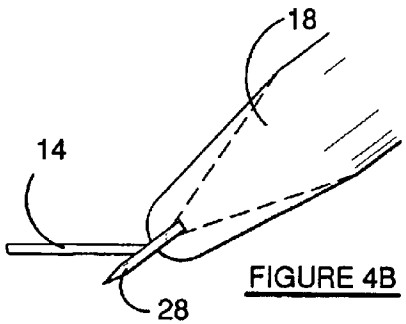
FIG. 4B is a side view of the part of the web member of FIG. 4A.
Figure 5:
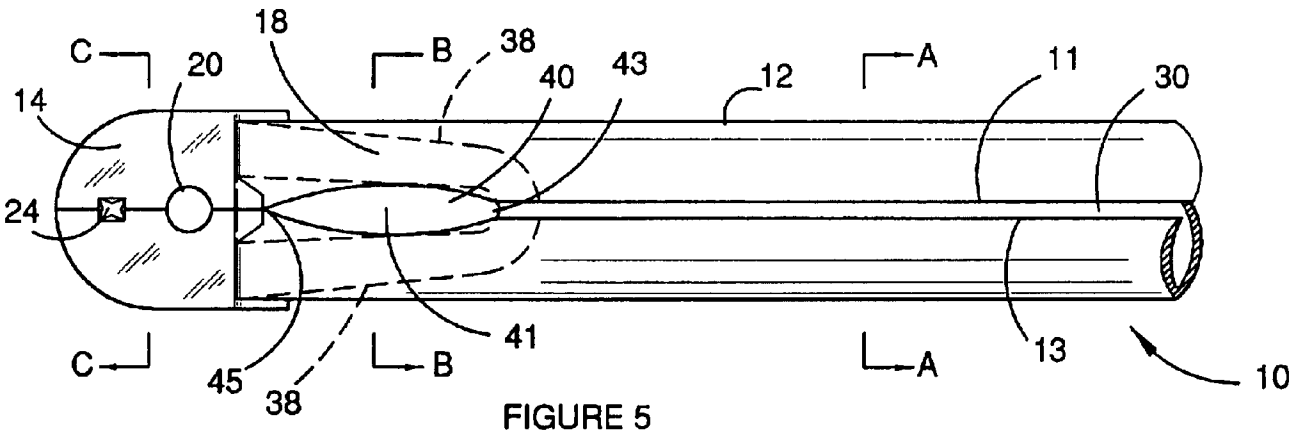
FIG. 5 is a view of an end of a reinforcing web member according to a third embodiment of the invention.
Figure 8:
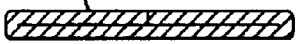
FIG. 8 is a cross-sectional view along the line CC of FIG. 5.
Figure 7:
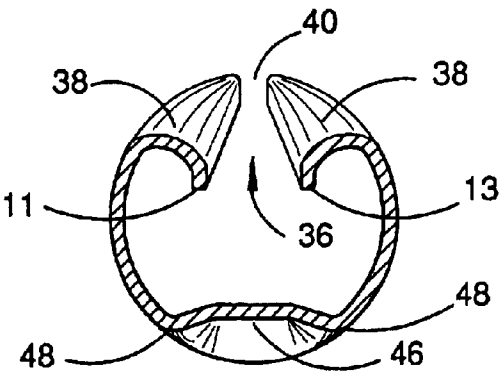
FIG. 7 is a cross-sectional view along the line BB of FIG. 5.

FIG. 3 shows a second embodiment of the invention in which like reference numerals indicate like parts of those described with reference to FIGS. 1 and 2. In this embodiment of the invention, rather than form the barbs from a burst hole in the tab 14, the barbs are in the form of teeth 28 (best shown in FIGS. 4A and 4B) which are cut from side portions of the tab 14 before bending of the tab 14 so that the cut portions which form the teeth 28 remain parallel with the longitudinal axis X of the web member body 12.

In still further embodiments, not shown, the barbs could be formed by forming a cut in the tab 14 at the outermost end of the tab 14 and folding portions of the tab 14 adjacent the cut downwardly so as to create teeth extending transversely with respect to the tabs 14.

Figure 6:
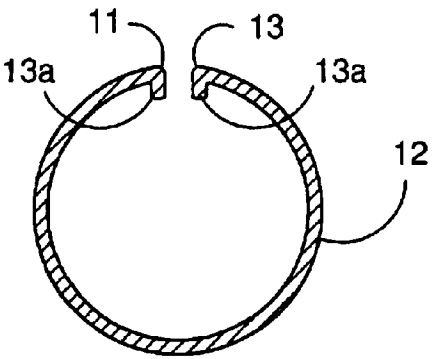
FIG. 6 is a cross-sectional view along the line AA of FIG. 5.

FIGS. 5 to 8 show a still further embodiment of the invention. In this embodiment the web member 10 is formed from a rolled blank and without joining free edges 11 and 13 of the blank together so that a central slot 30 extends along the length of the web member body 12 from one end of the web member body to the other. The free edges 11 and 13 may have inwardly extending flanges 13A which provide greater structural integrity to the web member body 12. The flanges 13A can be formed during rolling of the web member body 12 by first rolling the flanges 13A at the free edges of the blank from which the web member body 12 is formed and then rolling the blank into the tubular shape having the circular cross-section as shown in FIG. 6.

Ends of the rolled blank are then deformed in the same manner as described with reference to the above-mentioned International application so as to form a transition section 18 and a tab 14. In this embodiment the tab 14 is provided with the hole 20 and also the burst hole 26, although rather than the burst hole 26, teeth 28 could be formed as in the embodiment of FIGS. 3 and 4.

The deformation of the ends of the rolled tube 12 is such that a valley 36 is formed between a pair of ridges 38 with the valley including a slit 40 which is an extension of the slot 30. The valley 36 is formed by pressing free edges 11 and 13 in the transition region 18 inwardly and downwardly so that they spread in central region 41 of the slit 40 as shown by cross section B and the slit 40 tapers inwardly from central region 41 to one end 43 which merges into the slot 30 and to other end 45 which is adjacent tab 14. The pressing of the free edges 11 and 13 inwardly to form the slit 36 also adds to the structural integrity of the web member 10. The opposite side of the transition section 18 is also formed with a valley 46 which is located between the pair of ridges 48. As in the above-mentioned International application, the tab 14 can be trimmed so as to maintain the width of the tab 14 generally within the confines of the body 12 so that the tab 14 is substantially no wider than the body 12.

Figure 9:
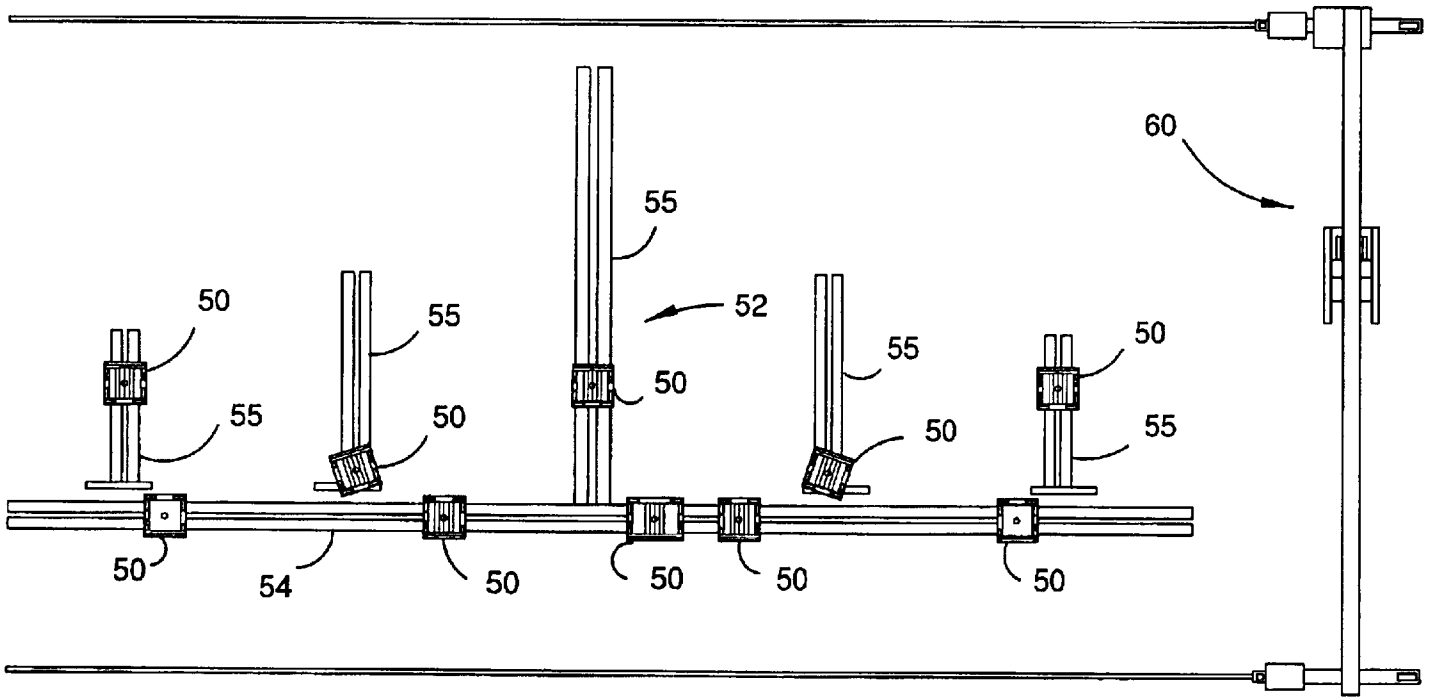
FIG. 9 shows a pedestal layout for manufacturing a structural framework in the form of a building truss having inclined upper chords and a horizontal lower chord joining the upper chords.

FIG. 9 shows a pedestal layout for forming a truss using metal web members of the type described with reference to the embodiments of FIGS. 1 to 8. Pedestals 50 are arranged on a base rail 54 and outrigger arms 55. The outrigger arms 55 can be moved into various positions and the pedestals 50 moved on the outrigger arms and also on the base rail 54 to position the pedestals 50 at required places to support chords (not shown in FIG. 9) of a building truss. The jigging system 52 can be of conventional design, or of the type disclosed in our Australian Patent Application No. 18313/01, the contents of which are incorporated into this specification by this reference. A gantry press system 60 is provided for pressing nail plates into the wooden chords so as to secure the chords together in a manner which is also well known and therefore will not be described in any further detail. The pedestals 50 are generally of known design and therefore will not be described in further detail except as is necessary to explain differences between the conventional form of the pedestals 50 and those of the preferred embodiments of the present invention.

Figure 10:
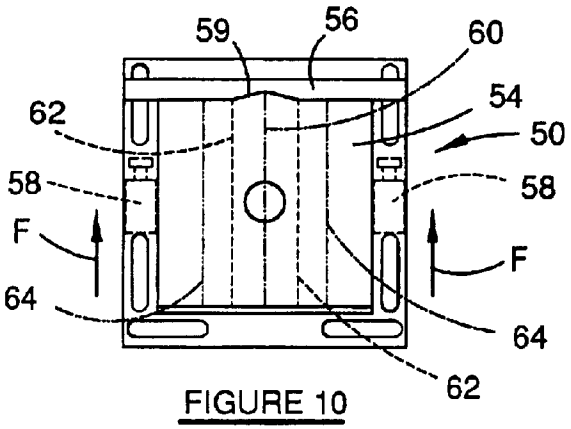
FIG. 10 is a plan view of a pedestal used in the embodiment of FIG. 9.

FIG. 10 is a plan view of a pedestal commonly called an apex box which is arranged on outrigger arm 55' in FIG. 9. The pedestal 50 of FIG. 10 has an upper support platform 54 and an abutment rail 56. A clamp 58 is provided for providing a clamping force to an inner surface of a chord as will be described in more detail hereinafter or, in other words, a clamping force that is directed towards the outside of the truss profile, in the direction of arrow F, so as to push the chord supported by the pedestal 50 of FIG. 10 firmly into abutment with the abutment rail 56 and hold the chord fixed in a prescribed position. The abutment rail 56 of the apex box type pedestal 50 shown in FIG. 10 has a v-shaped notch 59 in which ends of the chords which define the apex of the truss are located. When the clamp 58 is moved into clamping position, the ends of the chords are pushed into the v-shaped notch 59 and abut one another. A second clamp 58' is provided on the other side of the platform 54 for clamping the other chord which will define the apex of the truss.

The support platform 54 of the pedestal 50 is provided with a number of markings which show regions in which reinforcing web members of the type described with reference to FIGS. 1 to 8 can be connected to the chord supported on the support platform 54. The markings include a first central marking 60, a pair of second markings 62 spaced, for example, 50 mm from the line 60, and a pair of third markings 64, each spaced 100 mm from the line 60. The markings 60, 62 and 64 may be colour-coded and simply provided by drawn lines or lines formed from tape on the platform 54. The pedestal 50 of FIG. 10 can be used as a pedestal for locating the apex of the truss or, it can be used along the length of one of the upper chords in which case it merely performs the function of a top chord box. If the pedestal is being used as an apex box to define the apex of the chord, the lines 64 are used to define the web member connection point of the web members adjacent the apex. These web members are usually the first connection made so that the web members, which will be connected adjacent the apex of the truss, are connected with the respective holes 20 of the respective tabs 14 being aligned with the line 64. If the apex box is simply used as a top chord box for forming a web member connection at a place other than the apex, the lines 62 are used to define the ideal or preferred location point for aligning the holes 20 of the web members to connect the web member to the chord. The lines 64 define a distance range with the line 60 in which the web members can be connected. Thus, the lines 62 show the location of a preferred web member connection point of a reinforcing web member with the chord and the lines 64 with the lines 60 define a connection region in which, depending on the length of the web member selected from a stock set of lengths, the web member can be connected to the respective chords so as to ensure the structural integrity of the formed truss.

The marking 60 defines a theoretical connection point which is used in the analysis and calculation of a web member layout for a particular truss which will provide the truss with the required structural integrity in order to perform the intended function of the truss. Typically, a number of theoretical connection points will be defined on the chords of the truss to which theoretical web members could be connected to provide that structural integrity. When a truss is designed, various truss layouts which include the chords and the web members are produced in software so that the location of the web members relative to the chords is determined. Generally the software may run through various routines and place web members in different positions in order to determine a required layout which provides the structural integrity of the truss. Once this has been done, theoretical connection points are determined and are then fixed. As explained above, these theoretical connection points are defined by the markings 60 and when the pedestals are moved under the control of the software or otherwise, those points 60 are located relative to the chords to define the theoretical connection points. The theoretical connection points are not the points at which the web members will actually be connected, but merely theoretical points which provide the required structural analysis. The actual preferred connection points are spaced on either side of the theoretical connection point by a distance of, for example, 50 mm which is given by the markings 62 or at least within the range defined by the markings 60 and 64.

In conventional truss analysis and design, theoretical connection points are also determined but those theoretical connection points are moved to provide the actual connection points at which the two adjacent web members are fixed. Because the two adjacent web members must be fixed at that point, less freedom is provided in the selection of web members from a stock set of lengths whereas, with the present invention, because the web members are actually connected a distance from the theoretical point, much greater flexibility is provided.

Thus, in the preferred embodiment of the invention, the metal web members of the preferred embodiment are connected to the chords a distance spaced from the theoretical connection point which is determined in analysis to set out a web member layout for the truss which will provide the required structural integrity. Preferred connection points a predetermined distance from the theoretical connection point and on each side of the connection point are then used to connect adjacent web member ends so as to provide the required structural integrity.

Thus, in the preferred embodiment of the invention, rather than connect the web members at the theoretical connection point, the web members are connected so that adjacent web members are spaced apart by a distance preferably equal to the distance between the marking 62. However, the adjacent web members could be connected so that one web member is connected to the chord anywhere in the connection region between the markings 60 and 64 and the other web member is connected anywhere between the marking 60 and the other of the markings 64.

Figure 11:
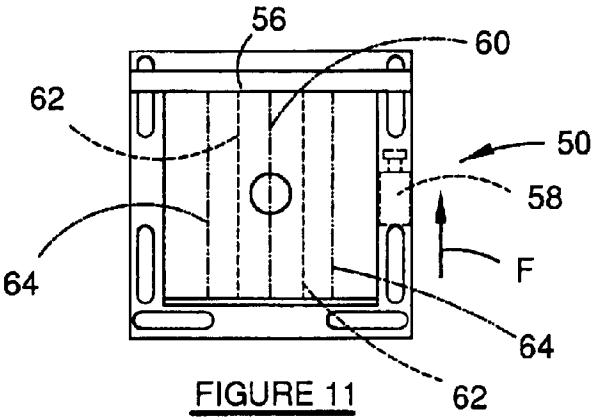
FIG. 11 is a plan view of another pedestal used in the embodiment of FIG. 9.

FIG. 11 shows a pedestal 50 in the form of a universal box which can be provided on the outrigger arms 55 other than the arm 55'. This box is basically the same as the box of FIG. 10 except it does not have a notch 59 in the abutment bar 56 because the abutment bar 56 will abut a straight edge of one of the inclined upper chords of the truss. The pedestal 50 of FIG. 11 includes clamps 58 which are identical to the clamps of the pedestal 50 shown in FIG. 10. This box also includes markings which comprise a first marking 60 which defines a theoretical connection point for a reinforcing web member, a second pair of markings 62 which define preferred connection points which are spaced from the theoretical point by the distance of 50 mm, and a third set of markings 64 which are spaced from the line 60 by 100 mm, and which, with the markings 60, define a connection region in which a reinforcing web member can be connected to a chord so as to ensure the structural integrity of the truss.

Figure 12:
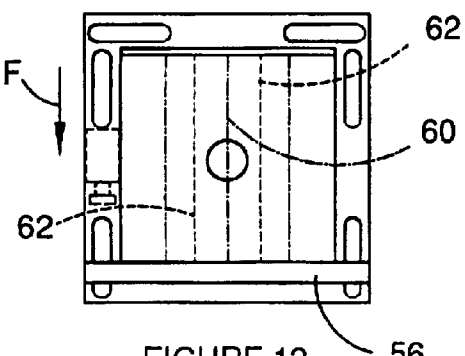
FIG. 12 is a view of a still further pedestal.

FIG. 12 shows a universal box which has the same marking with the same spacings as the box of FIG. 11. This box is preferably used on the rail 54 and has an abutment rail 56 and a clamp 58 which will provide a clamping force in the direction of arrow F to clamp an inner surface of the lower chord or, in other words, to provide a clamping force directed outwardly of the truss so as to push the lower chord hard against the abutment rail 56.

Figure 13:
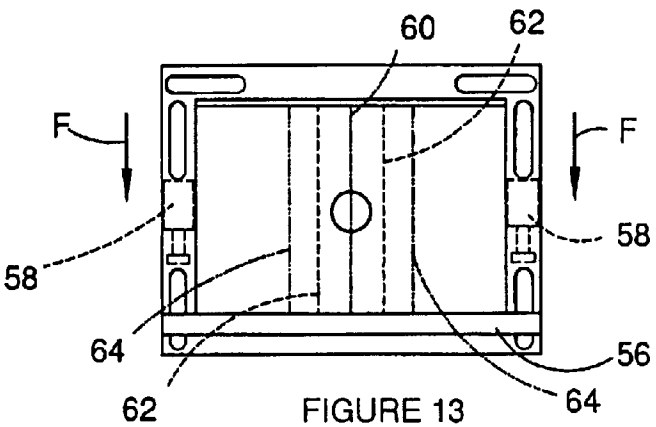
FIG. 13 is a view of a still further pedestal used in the embodiment of FIG. 9.

FIG. 13 shows a splice box which is the box 50" on rail 54 in FIG. 9 and which can be positioned where two pieces of timber which are to form the lower web member abut one another and which are joined by a nail plate so as to form the lower chord of the truss. This box can also be used as a pedestal which defines a connection point for a web member as well as a splice between pieces of timber which define a chord and therefore also has markings which are identical to the markings of FIGS. 10, 11 and 12 and clamps 58 which provide a clamping force in the direction of arrow F in FIG. 13.

Figure 14:
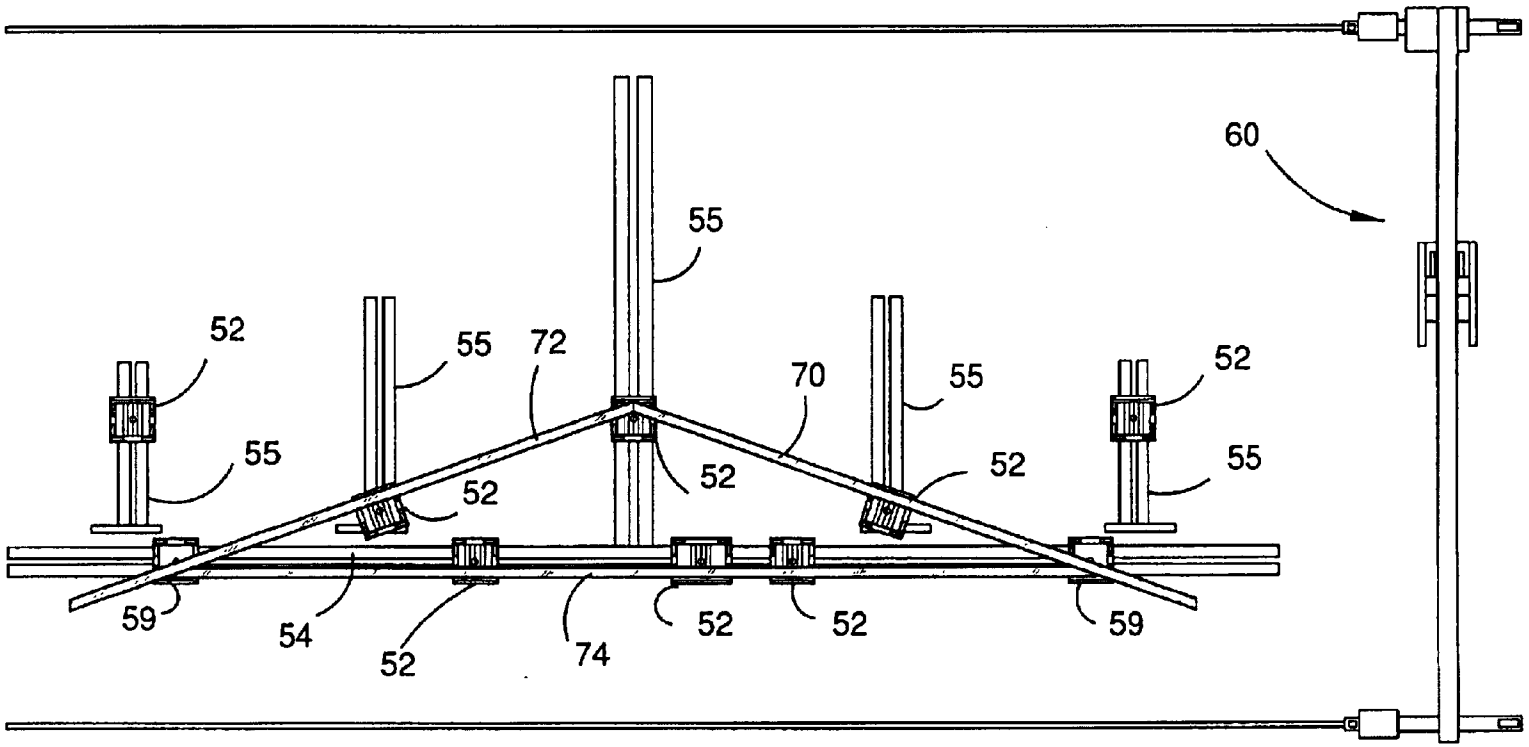
FIG. 14 is a view similar to FIG. 9 but with the chords laid out to form a building truss.

FIG. 14 shows chords 70 and 72 which are inclined with respect to one another and form the upper chords of the truss and bottom chord 74 positioned in place on pedestals 52. The chords are preferably made from wood but could also be made from metal. It should be noted that not all the pedestals 52 in the system need be used in order to support the chords 70, 72 and 74 and form the truss. As is conventional, pedestals in the form of heel boxes 59 are located at the ends of the truss where the upper chords 70 and 72 join with the lower chord 74. These pedestals are completely conventional in nature and need not be marked because reinforcing web members will not be connected to the parts of the chords supported by these pedestals.

The chords 70, 72 and 74 are connected together by nail plates which are pressed into the chords 70, 72 and 74 in a conventional manner which therefore need not be described.

Figure 14A:
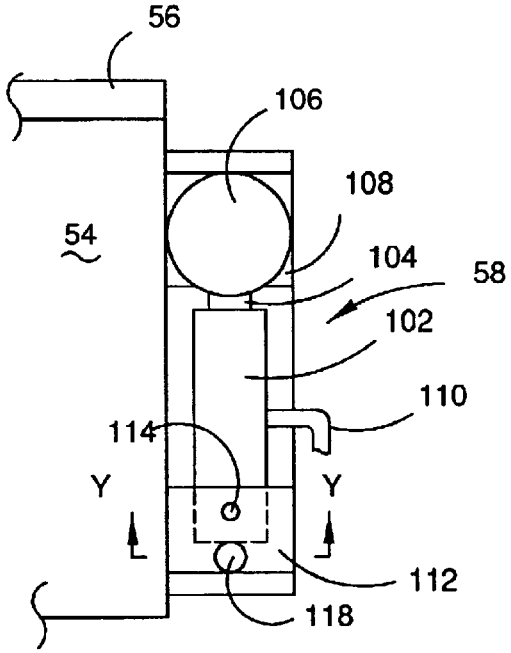
FIG. 14A is a plan view of a pedestal including a clamp of the preferred embodiment.
Figure 14B:
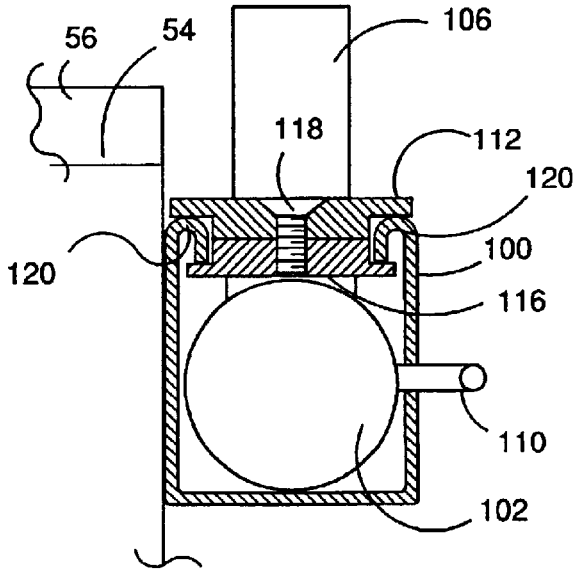
FIG. 14B is a view along the line Y—Y of FIG. 14A.

FIGS. 14A and 14B show the clamp 58 which is used on the pedestals of FIGS. 10 to 13. As is apparent from FIGS. 10 to 13, the pedestal shown in FIG. 10 shows two clamps, the pedestal in FIG. 11 a single clamp, the pedestal in FIG. 12 a single clamp and the pedestal in FIG. 13 two clamps. Only one of the clamps is shown in FIG. 14A but the other, if the pedestal includes two clamps, is identical.

The clamp 58 comprises a channel section 100 which contains a pneumatic or hydraulic ram 102. The ram 102 has a ram arm 104 which is connected to a clamp element 106 in the form of a cylinder which extends up above the channel 100. The cylinder 106 can be connected with a block 108 to facilitate sliding movement of the cylinder 106 within the channel 100 when the ram arm 104 is extended to provide a clamping force. Fluid to power the clamp 58 may be supplied by a line 110.

A sliding plate 112 is mounted on the channel 100 and is coupled to the cylinder 102 by a screw 114 to secure the rear of the cylinder within the channel 100. The plate 112 has a lower T-shaped plate 116 which is connected to the plate 112 by a screw 118 so that when the screw 118 is tightened, the plates 112 and 116 are pulled together so as to clamp the plate 112 to in-turned flanges 120 of the channel 100. By loosening the screw 118, the plate 112 can be moved along the length of the channel 100 to position the ram 102 in the required position depending on timber size.

Figure 15:
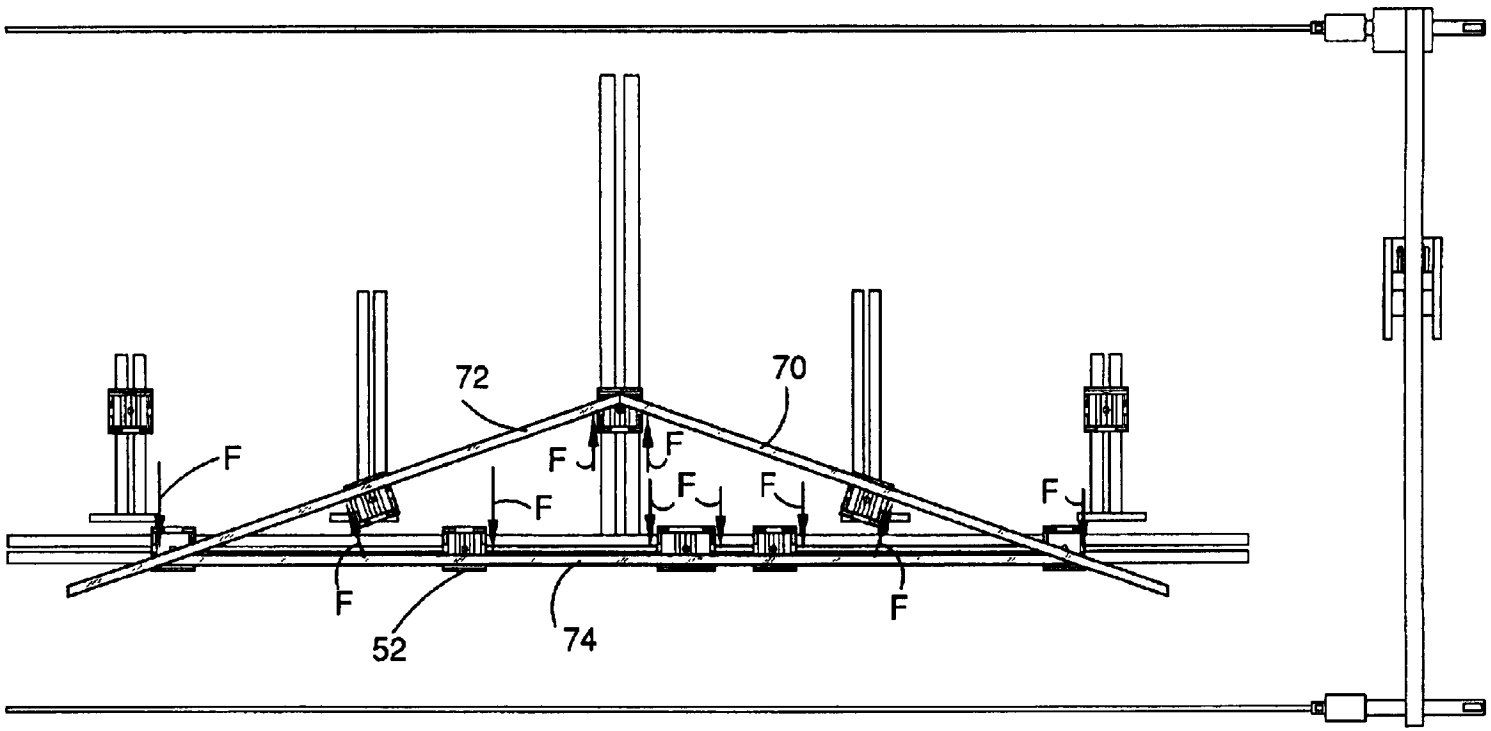
FIG. 15 is a view showing the application of clamping force to the chords of FIG. 14.

FIG. 15 is a view similar to FIG. 14 but including the arrows F which show the clamping force provided by the clamps 58 which clamp against inner surfaces 70', 72' and 74' of the chords 70, 72 and 74 respectively or, in other words, provide a clamping force which is directed outwardly of the truss and which push the chords 70, 72 and 74 hard against the abutment rails 56 of the pedestals 52.

The clamps 58 together with the abutments 56 define the geometrical shape of the truss formed from the chords 70, 72 and 74 in its final orientation before location of the reinforcing web members 10 within the chords 70, 72 and 74 to complete the truss.

Figure 16:
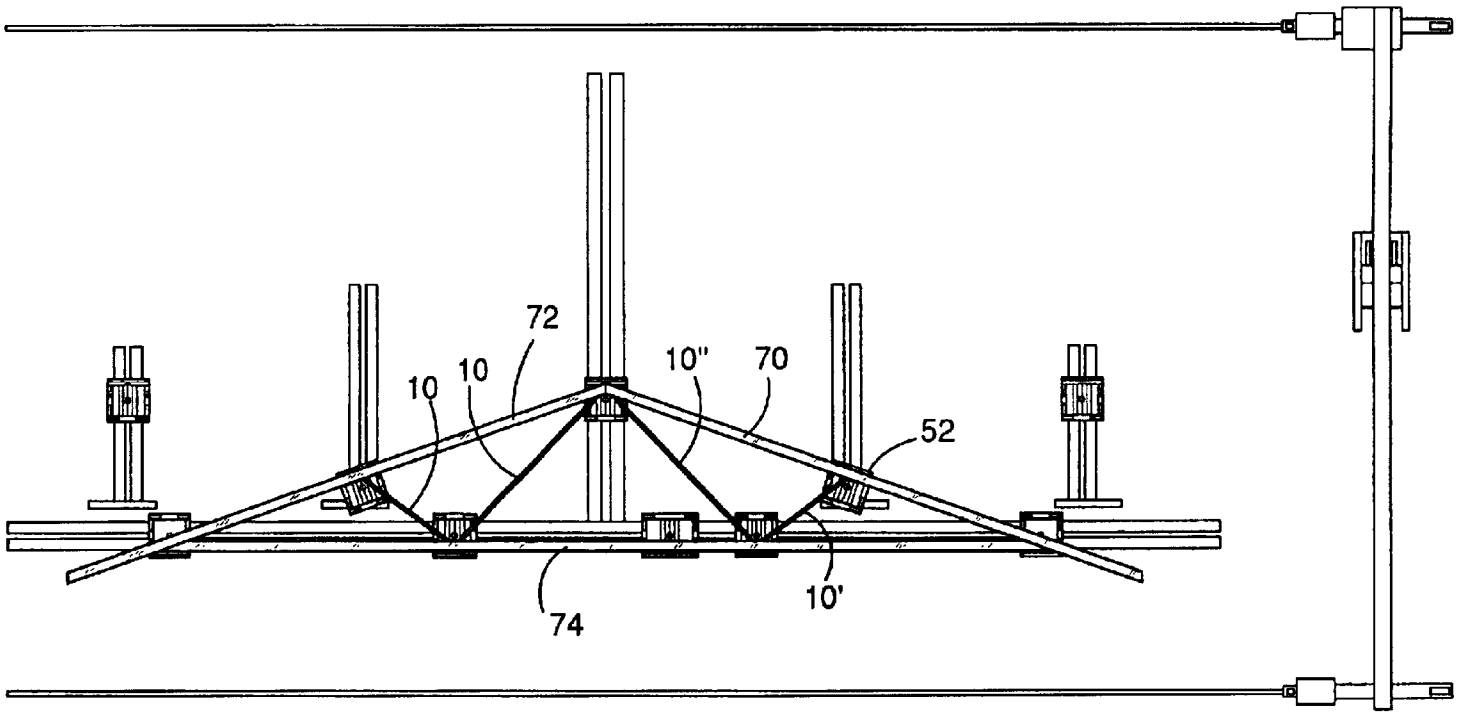
FIG. 16 shows the formed truss including reinforcing web members.

FIG. 16 is a view similar to FIG. 15 showing the reinforcing web members 10 secured in position so as to complete the truss.

The pedestals 52 are positioned in a manner known per se usually under the control of a computer program so as to support the chord 70 in the vicinity of connection points at which the reinforcing web members 10 will connect to the chords 70, 72 and 74. After the pedestals are located in place, the chords are located on the pedestals and are clamped in place by the clamps 58 and the abutment rails 56 to define the geometry of the truss before the web members 10 are connected in place.

Figure 18:
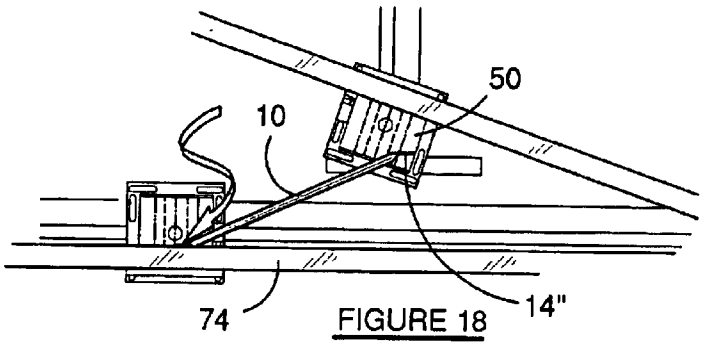
FIG. 17, FIG. 18, FIG. 19 and FIG. 20 are a sequence of drawings showing installation of a reinforcing web member according to the preferred embodiment of the invention.

FIGS. 17 to 20 explain the connection of the reinforcing web members 10 and, in particular, the connection of the reinforcing web member 10' in FIG. 16. In general, the web members 10 are laid out and supported on the pedestals 52 as shown in FIG. 16 before any of the web members 10 are secured in place. The web member marked 10" in FIG. 16 is usually connected in place first. The pedestals 50 are moved into position so that the mark 60 of the pedestals, which defines a theoretical connection point of web members 10' to the chords 70, 72 and 74, is located at those theoretical connection points. The web member 10" is secured in place in the same manner as the web member 10' and this securement process will be described in detail with reference to FIGS. 17 to 20 which applies to the web member 10'. The web member 10' is first positioned so that the tab 14 is located in place so that the hole 20 through which the screw (not shown) will pass is in alignment with the mark 62 which defines the preferred connection point which is spaced a predetermined distance from the connection point 60. The pre-bend of the tab 14 facilitates general support of the reinforcing web member 10 by the pedestals 50 shown in FIG. 17 because the pre-bend will tend to orient the web member 10 generally in the position shown in FIG. 17 when the bend 14 sits generally flush with the surface 74*a* of the chord 74. A screw can then be easily driven through the hole 20 in the tab 14 so as to secure the tab 14 to the surface 74*a* of the chord 74.This securement is shown in FIG. 18 and it can be seen in FIG. 18 that the web member 10 is inclined with respect to the chord 20 and generally sits on an edge of the pedestal 50 because of the pre-bend in the tab 14. The spiral arrow in FIG. 18 represents installation of the screw (not shown) through the hole 20 to connect the tab 14 to the chord 74.

Figure 19:
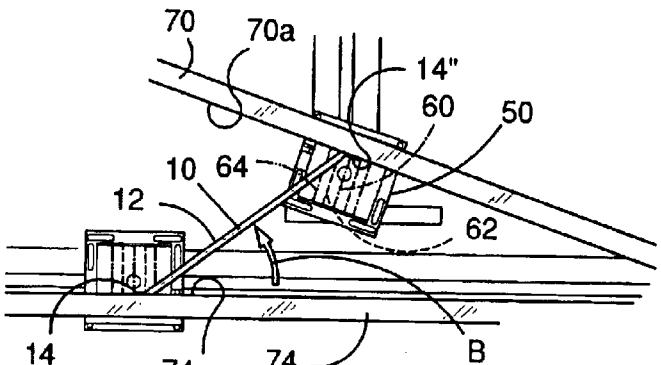

As shown by FIG. 19, the web member 10 is then gripped by a workman (not shown) and pulled in the direction of arrow B so as to pull the other tab labelled 14' in FIG. 18 flush against the surface 70*a* of the chord 70. This movement bends the web member body 12 of the web member 10 with respect to the fastened tab 14 so the body 12 takes up its final orientation with respect to the tab 14. The pre-bend of the tab 14 ensures that the radius of curvature of the bend between the tab 14 and the transition 18 is as small as possible so that the tab 14 sits flush and tightly against the surface 74*a* of the web member 74. The workman pulls the web member 10 into position so that the hole in the tab 14" falls within the limits defined by the mark 60 and the mark 64 in FIG. 19. When the tab is pulled into this position, the workman knows that the tab 14" is located in the correct position. Most preferably the hole 20 will be on the preferred mark 62 but depending on the size of the web member 10 which is selected and accuracy of positioning of the pedestal 52 and the contour of the chord 70, the hole 20 may not be exactly on the mark 62. However, provided that the hole 20 falls within the region between the mark 60 and the mark 64, the workman will know that the web member 10 is properly positioned.

Figure 20:
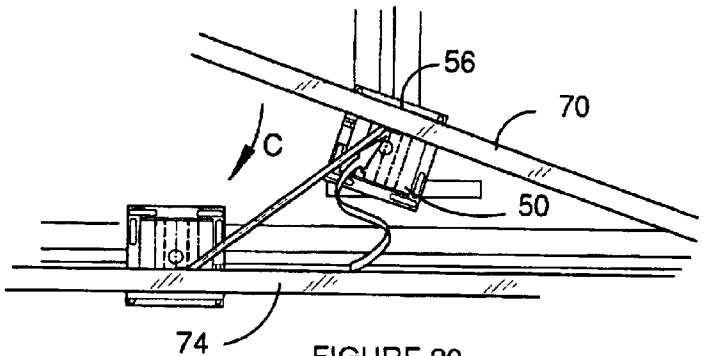
Figure 17:
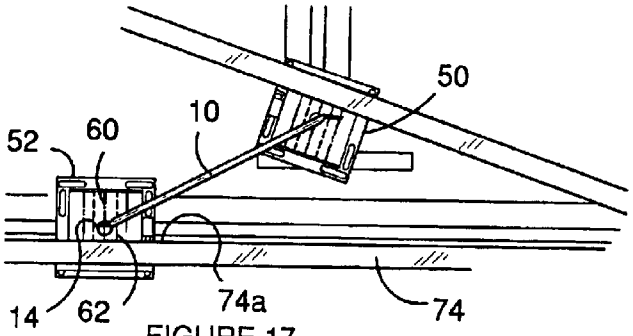
Figure 21:
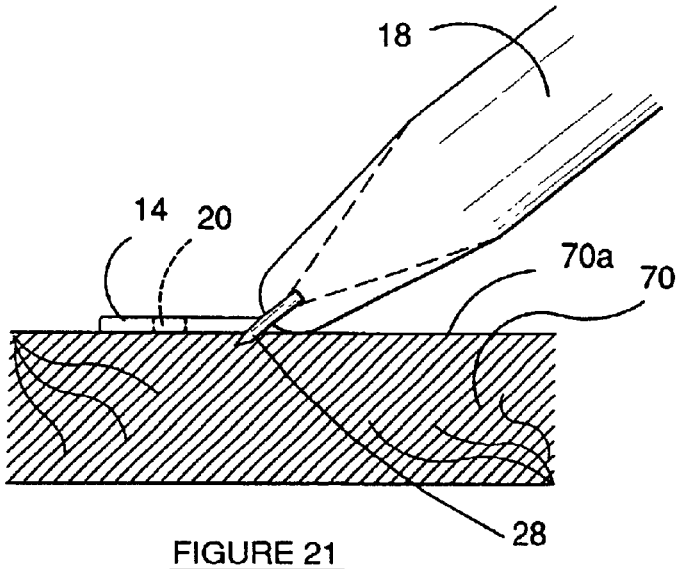
FIG. 21 is a view of a web member held temporarily against a chord awaiting final securement.

When the web member 10 is pulled into the position shown in FIG. 19, the barbs 26 or 28 which are formed on the tab 14", as described with reference to FIGS. 1 to 4, will bite into the surface 70*a*, as shown in FIG. 21, and when the workman releases the web member 10, the embedding of the barbs into the surface 70*a* will prevent the web member 10 from moving or sliding on the surface 70*a* in a direction opposite arrow B. Thus, once the web member 10 has been pulled into position the workman knows that the web member will hold in that position because of the embedding of the barbs 26 or 28 into the surface 70*a* and the workman then has two free hands available to him to use a drill or other work piece in order to screw a screw through the hole 20 in the tab 14" and securely fasten the tab 14" to the surface 70*a* of the chord 70. As the workman pulls the web member 10 into the position shown in FIG. 19, the tab 14" will bend further from the original position shown in FIGS. 1 to 4 and into its final orientation with respect to the web member 10. Once again, the slight pre-bend will ensure that the radius of curvature between the transition region 18 of the tab 14" is as small as possible so that the tab 14" sits flush and tightly against the surface 70*a*. FIG. 20 illustrates by the spiral arrow shown in FIG. 20 the securement of the tab 14" in place.

The securing of the web member 10 and, in particular, the securement of the screw which will locate the tab 14' to the web member 70 as shown in FIG. 20, will have the tendency to pull the web member 70 inwardly in the direction of arrow C in FIG. 20 towards the chord 74. The tendency of the chord 70 to move in the direction of arrow C, or in other words, for the chord 70 and 74 to pull together is prevented by the clamps 58 which provide a clamping force on the inner surfaces 70*a* and 74*a* of the chords 70 and 74, or in other words, a clamping force directly outwardly of the truss. Thus, the clamping of the inner surface which defines the final geometry of the truss prevents the chords 70 and 74 from moving during installation of the web members 10 which may otherwise occur, particularly if the holes 20 in the tabs 14 do not align exactly with the preferred connection points shown by the mark 62 on the pedestals 52.

As is apparent from a consideration of FIGS. 16 to 20, when the web members 10 are secured in place, the holes 20 in the tabs 14 are spaced apart from one another a predetermined distance from the theoretical connection point 60 preferably by a distance given by the preferred connection point 64 but, in any event, within a region defined by the markings 60 and 64. The tabs 14 are also spaced-apart and do not abut one another. The spaced apart connection of the web members 10 in this manner provides greater flexibility in the selection of web members 10 from a stock set of web member lengths and therefore the formation of trusses using those web members.

Figure 22:
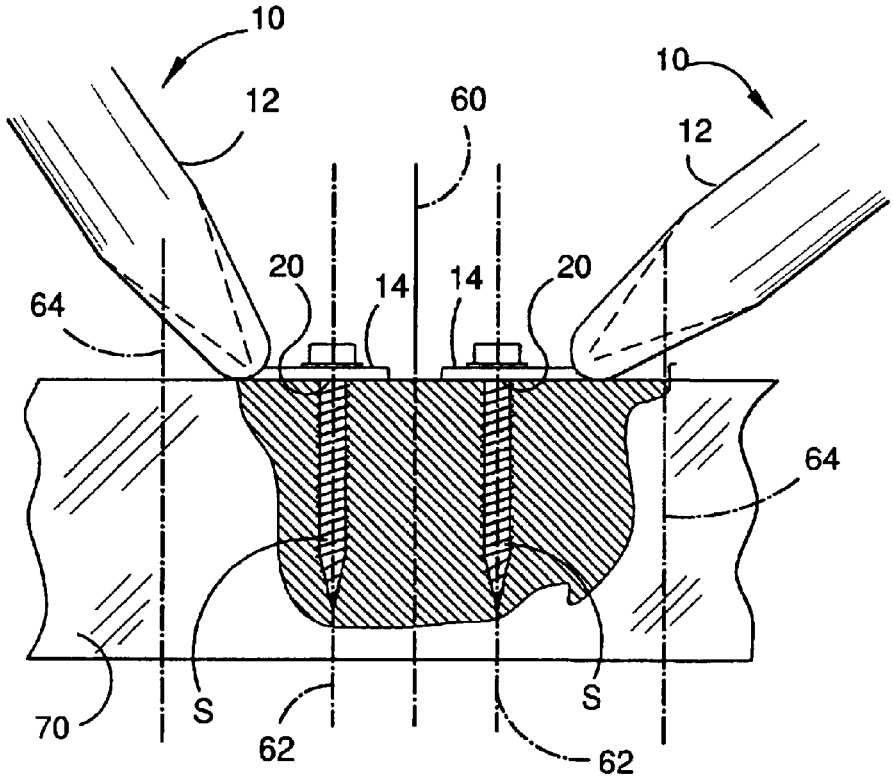
FIG. 22 is a view of web members in final secured position.

FIG. 22 shows an adjacent pair of web members 10 secured to one of the chords, such as the chord 70. As is apparent from consideration of FIG. 22, the web member connection points which are defined by the holes 20 through which screws S are driven so as to secure the tabs 14 to the chord 70, are spaced apart from the theoretical connection point 60 shown in dotted lines. The screws and holes 20 are in alignment with the preferred connection point 62, and obviously within the range defined by the lines 64. The web members 10 shown in FIG. 22 define a pair of web members which have ends which are shown in FIG. 22 which are closest together and secured in the above manner. The other ends of the web members 10 shown in FIG. 22 are secured to a top chord or top chords and with another web member, not shown, will define another pair of web members which have ends close together and which are connected in the same manner as described with reference to FIG. 22.

What is claimed is:

1. A reinforcing web member for a structural framework which is assembled from a plurality of chords and reinforcing web members, said web member comprising:

a web member body having a longitudinal axis and opposite first and second ends;

a first securement tab at the first end of the web member body and a second securement tab at the second end of the web member body, each tab being configured for engagement with one of said chords and adapted to be permanently secured to the chord by receiving a fastener through the tab;

at least one ancillary connector on each securement tab for temporarily holding the web member in position in the framework to enable a workman to permanently secure the tab to the chord, the ancillary connector comprising a burst hole which has multiple barbs spaced around a periphery of the hole, each of said multiple barbs projecting transversely with respect to the tab for embedding in said chord upon application of direct manual force when the workman, without use of a tool, pulls the tab into engagement with the chord; and a bend line defined at each end of the web member body for bending the respective securement tab, each tab being bent along its respective bend line at an oblique angle with respect to the longitudinal axis of the web member body;

wherein each securement tab has opposing flat, parallel faces including a front face from which said multiple barbs of the burst hole project outward and a back face;

and wherein a portion of each tab disposed between its bend line and its tip end lies within a flat plane generally defined by the first and second faces, the tab being free from further bends beyond the bend line such that the entire said portion of each tab lies within said plane;

and wherein the first and second tabs are bent in opposite directions with respect to the longitudinal axis, the barbs at each burst hole projecting toward the longitudinal axis such that the front face and the barbs face generally away from the web member body toward and for engagement with a respective one of the chords.

2. The reinforcing web member of claim 1 wherein the barbs of the ancillary connector each comprise a portion of the tab which is deformed from the tab during formation of the burst hole.

3. The reinforcing web member of claim 1 wherein the web member body is formed from a tube having free edges which are adjacent one another and which define therebetween a longitudinal slot, and further comprising a transition between the web member body and tab defined by a deformation including a valley aligned with the longitudinal slot in the web member body.

4. The reinforcing web member of claim 1 wherein each securement tab has a tip which comprises an axial extremity of the web member body, and wherein the burst hole is located generally adjacent said tip.

5. The reinforcing web member of claim 4 further comprising a fastener hole on the securement tab for receiving said fastener, and wherein the burst hole is positioned closer to said tip than the fastener hole.

6. The reinforcing web member of claim 5 wherein there is exactly one burst hole on each securement tab which comprises the only ancillary connector on said tab.

7. The reinforcing web member of claim 6 wherein said burst hole is positioned along said longitudinal axis generally at a lateral center of the web member.

* * * * *